United States Patent [19]

Hirasawa et al.

[11] Patent Number: 4,866,482

[45] Date of Patent: Sep. 12, 1989

[54] IMAGE FORMING DEVICE FOR ELECTROSTATIC RECORDING APPARATUS HAVING A SLIDABLE REPLACEMENT HOLDING CASE

[75] Inventors: Junichi Hirasawa, Hiratsuka; Yutaka Kodama, Tokyo; Kenya Komada, Yokohama; Takefumi Adachi, Tokyo, all of Japan

[73] Assignee: Ricoh Company, Ltd., Tokyo, Japan

[21] Appl. No.: 109,511

[22] Filed: Oct. 19, 1987

[30] Foreign Application Priority Data

| | | | |
|---|---|---|---|
| Oct. 24, 1986 | [JP] | Japan | 61-252032 |
| Dec. 27, 1986 | [JP] | Japan | 61-311741 |
| Apr. 4, 1987 | [JP] | Japan | 62-082209 |

[51] Int. Cl.[4] ..... G03G 15/00

[52] U.S. Cl. ..... 355/260; 355/245

[58] Field of Search ..... 355/3 R, 4, 3 DR, 3 DD

[56] References Cited

U.S. PATENT DOCUMENTS

| | | | |
|---|---|---|---|
| 3,490,841 | 1/1970 | Cely, Jr. et al. | 355/3 DR X |
| 3,998,548 | 12/1976 | Wakatsuki | 355/3 DR X |
| 4,449,809 | 5/1984 | Tamura | 355/3 DR |
| 4,563,074 | 7/1986 | Tsutsui et al. | 355/3 DD |
| 4,583,832 | 4/1986 | Kasamura et al. | 355/3 DD |
| 4,593,993 | 6/1986 | Imaizumi | 355/3 R |
| 4,605,299 | 8/1986 | Mochimaru | 355/3 DR X |
| 4,708,455 | 11/1987 | Kubota et al. | 355/3 DR X |
| 4,740,767 | 4/1988 | Kawano et al. | 355/3 DD |
| 4,757,344 | 7/1988 | Idenawa et al. | 355/3 DR |

FOREIGN PATENT DOCUMENTS

| | | | |
|---|---|---|---|
| 200051 | 12/1982 | Japan | 355/3 DR |
| 200052 | 12/1982 | Japan | 355/3 DR |
| 57870 | 4/1985 | Japan | 355/4 |

*Primary Examiner*—A. T. Grimley
*Assistant Examiner*—Edward Pipala
*Attorney, Agent, or Firm*—Oblon, Spivak, McClelland, Maier & Neustadt

[57] ABSTRACT

An image forming device for electrostatic recording apparatus which has a plurality of replacement units, and a case holding the replacement units and is integrally removable from the device body by sliding toward one direction, and in which each replacement unit is placed in operable position when the replacement unit holding case is set to a given position in the device body. In the replacement unit holding case, provided is a mechanism for automatically removing the position of each replacement unit further away from each other than the given setting position of each replacement unit, by pulling out the case from the device body.

4 Claims, 8 Drawing Sheets

IMAGE FORMING DEVICE FOR ELECTROSTATIC RECORDING APPARATUS HAVING A SLIDABLE REPLACEMENT HOLDING CASE

FIELD OF THE INVENTION AND RELATED ART STATEMENT

This invention relates to an image forming device for electrostatic recording apparatus.

Recently as electrostatic recording apparatus such as the electrophotographic copying machine, facsimile (FAX) and electrostatic printer are widely spreading, the recording apparatus in which not only toner is supplied but also a photosensitive member and a cleaning unit are replaced by user's hands is becoming available. In particular, with printers, it is strongly requested that such replacement operation can be readily made by common users. Therefore, so far a method has been employed in which a photosensitive member, developing unit, cleaning unit and charger are integrated into an image forming unit that is to be replaced when it has been used up for a predetermined period of time. But, in this case, the cost per one sheet of print becomes expensive, because the parts cost for the integrated image forming unit is high. And, it is wasteful that even a photosensitive member still not exhausted must be replaced together with the other units to the shorter life of the cleaning unit or the shorter interval of toner supply.

In this connection, to eliminate this kind of waste, another method has been commercially available in which a replacement cycle is set for each unit constituting the image forming unit and each unit is replaced independently. But, in this case, the replacement workability of each unit creates a problem. Particularly when replacing a photosensitive member, its surface isn't so hard that it may be finger imprinted or impaired due to contact or scratch with other parts, resulting in the deterioration of the function. And, there is a strong possibility of toner spill when replacing the developing unit and cleaning unit.

Accordingly, to have a better operability, a piece of equipment has made its appearance in which each replacement unit such as a photosensitive drum, a developing unit and a cleaning unit is set in a case that can be integrally removed slidably out of the very equipment together with those units therein. And when replacing a unit, the case is drawn out of the equipment to replace the target unit. But, in this event, when removing the old unit and inserting a replacing unit, there are possibilities of the unit getting contact with the adjoining units or dropping on them, resulting in damage on units, thus introducing concern for making worse the quality of subsequent prints.

OBJECT AND SUMMARY OF THE INVENTION

The object of the invention is to provide an image forming device which has a plurality of replacement units, and a case holding the replacement units and integrally removable from the device body by sliding toward one direction, and in which each of the above replacement units is placed in operable position when the above replacement unit holding case is set to a given position in the device body, and in which the above case is pulled out to replace a given unit, which can prevent the given unit from getting contact with adjoining units or the toner from spilling out when the given unit is being replaced.

To achieve the above object, an image forming device according to the invention adapted for an electrostatic recording apparatus having the above configuration is characterized in that: in the above replacement unit holding case is provided means for automatically displacing each of the above replacement units further away from each other, than the given setting position of each of the above replacement units.

By using this configuration, each replacement unit disposed in a means for holding replacement units all together can be placed in a home position or a close-to-each-other position necessary for operation when the means is inserted into the device body, and can be removed from the home position so as to relatively separate away from each other when the means is pulled out of the device body. Therefore, gaps will be made between them, thus making the replacement of the units easier, eliminating possibilities of adjoining vulnerable units being damaged when replacing each unit, and further allowing each unit to be taken out without toner spilling out of the cleaning unit or the developing unit.

These and other objects, novel features and advantages of the invention will be readily apparent from the following description taken in connection with the accompanying drawings.

DETAILED DESCRIPTION OF PREFERRED EMBODIMENT

Figure 1:
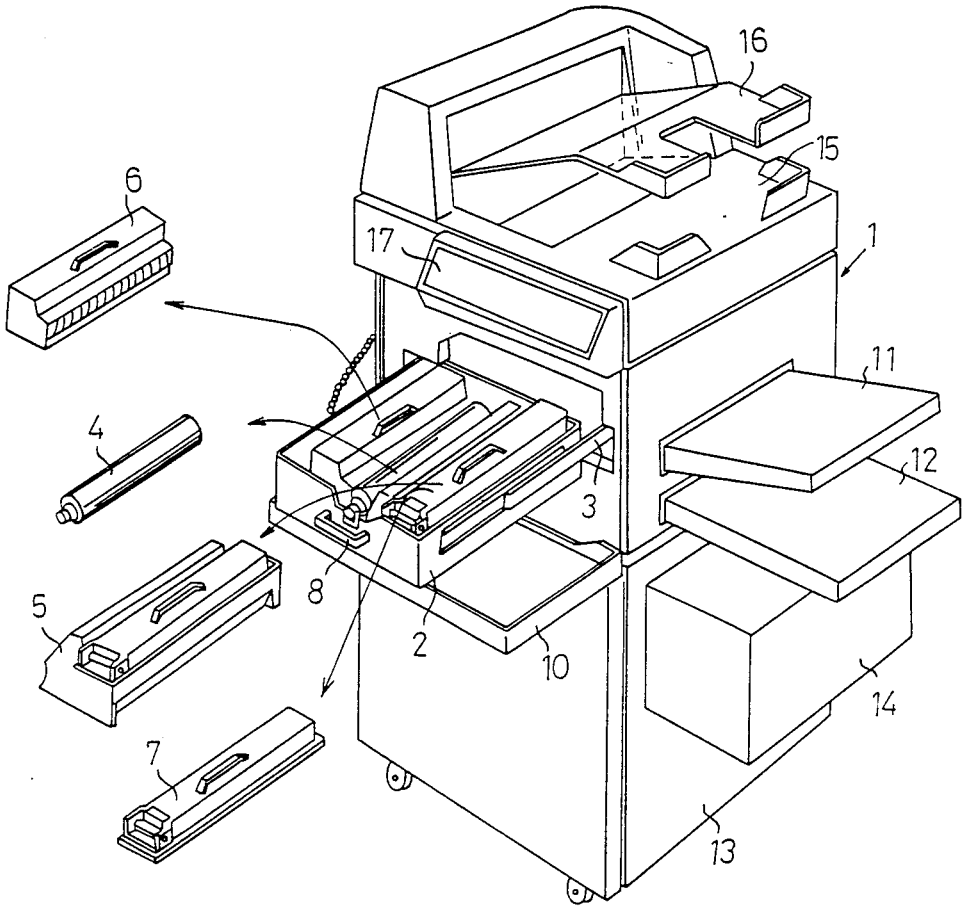
FIG. 1 is a perspective view of a laser printer, one embodiment according to the invention.
Figure 2:
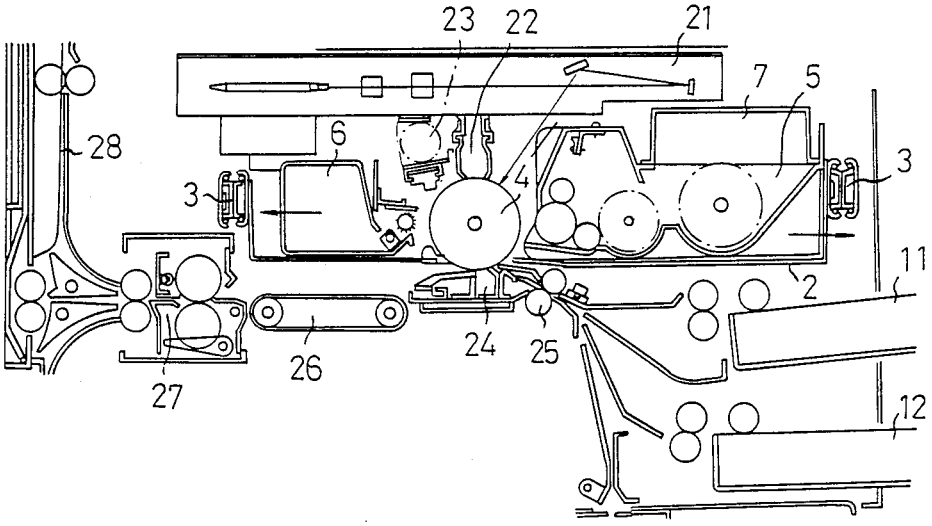
FIG. 2 is a partially sectional view of a drawer in FIG. 1.

FIG. 1 is a perspective view showing a first embodiment according to the invention, adapted for a laser printer. In FIG. 1, a drawer 2 supporting an image forming unit (including a unit to be replaced) has been pulled out of the laser printer body. FIG. 2 is a partially sectional view of the drawer 2 in FIG. 1.

As shown in FIGS. 1 and 2, the drawer 2 in the laser printer according to the embodiment is slidably supported on a side of the body 1 by support guide rails 3 and 3'.

In the drawer 2, an image forming unit consisting of a drum-shape photosensitive unit 4, a developing unit 5, a cleaning unit 6 and a toner cartridge 7 is removably housed. When the drawer 2 is pushed into the body 1, each of these units is so properly installed as to keep their relative positions that the recording operation of the electrostatic photographic process is rightly performed, and also is so properly located as to keep a relative best position to an optical unit 21, an electrocharger 22, a charge-removing lamp 23 and resist rollers 25 which are installed on a side of the body 1.

A handle 8 is installed on the front of the drawer 2 to pull out. Handles are attached respectively to the developing unit 5, the cleaning unit 6 and the toner cartridge 7. But the handles are not shown in FIG. 2.

In addition to the drawer 2 housing the above image forming unit and the optical unit 21 optically scanning over the photosensitive member, the body 1 is provided with a 1st feed paper cassette 11 and a 2nd feed paper cassette 12 supplying sheets of recording paper, as well as a fixing unit 27 fixing, by heat and pressure toner image on recording paper developed by the image forming unit. On the top of the printer body 1, provided are a 1st discharge paper tray 15 and a 2nd discharge paper tray 16 receiving printed sheets of recording paper discharged through a transfer passage 28.

The printer body 1 is installed on an option unit 13 consisting of a separate mass feed paper unit 14 used, if required, as a so-called option, and of a reversing unit (not shown) to reverse sheets of paper recorded on a side discharged from the fixing unit 27 and to transfer them again to the image forming unit.

A cover 10 is provided to prevent dust from flowing into the body 1 and to give a good appearance thereof, by raising the cover 10 to cover the side of the body 1 with the drawer 2 housed in.

Figure 3:
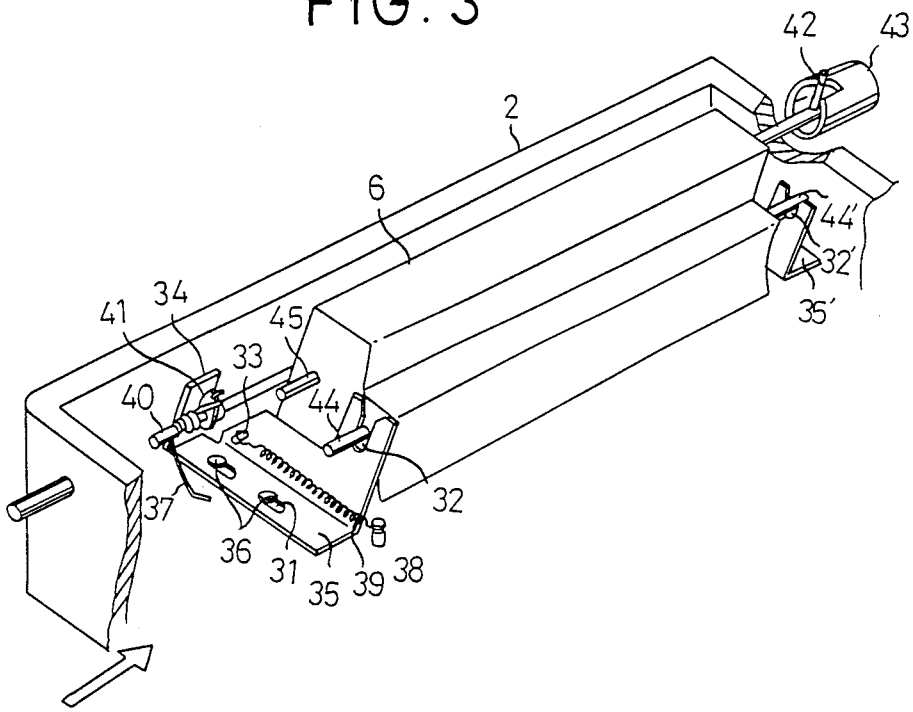
FIGS. 3 and 4 are respectively perspective and front views showing a mechanism which removes a cleaning unit 6 away from a photosensitive unit 4 by pulling out a drawer 2.
Figure 4:
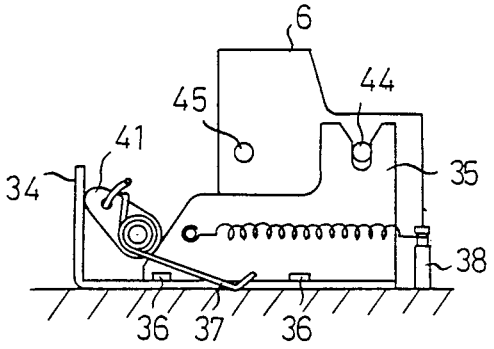

FIGS. 3 and 4 show a typical mechanism to remove the cleaning unit 6 away from the photosensitive unit 4 by pulling out the drawer 2.

A pair of sliders 35 and 35', which respectively have sliding slots 31, a cleaning unit supporting notch 32, a spring latching protrusion (pin) 33 and a cam plate 34, is provided on the front/back sides of the pulling direction of the drawer 2, and is fixed slidably to the drawer 2 by guide pins 36. And a spring 39 is secured between the spring latching protrusion 33 on the slider 35 and a spring latching pin 38 fixed on the bottom of the drawer 2.

An axis bar 40 is rotatably inserted into the front-/back side plates of the drawer 2, a cam 41 is fixed on the bar 40 to a position facing the cam plate 34 on the slider 35, and a torsion spring 37 is fixed to the bar 40 to rotate the bar 40 around its axis. Such kind of cam and spring is also provided on the slider 35' (not shown). To the back end portion of the bar 40, a pin 42 is attached so as to engage with a cam 43 fixed to the body 1.

Figure 5:
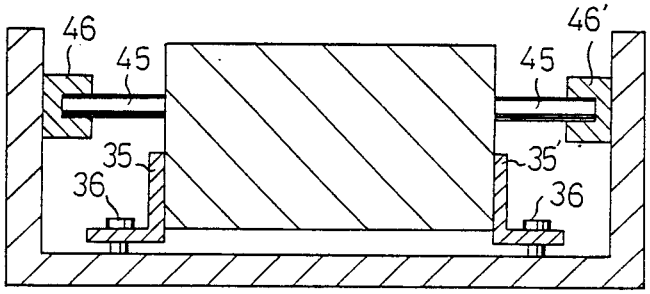
FIG. 5 is a view showing a mechanism which supports the cleaning unit 6 in the drawer 2.
Figure 6:
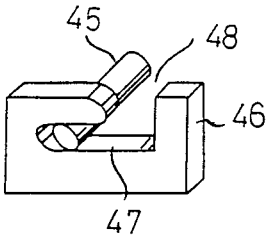
FIG. 6 is a view showing the bearing portion of a pin.

The cleaning unit 6 has four pieces of pins 44,44',45 and 45' at the front and back ends thereof, the two pins 44 and 44' are inserted into the notches 32 and 32' of the respective sliders 35 and 35' as shown in FIG. 4 to be supported by the sliders 35 and 35', and the rest two pins 45 and 45' are supported by pin support blocks 46 and 46' attached to the side walls of the body 1 as shown in FIG. 5. As shown in FIG. 6, the pin support blocks 46 and 46' have respectively pin sliding slots 47 to support the pins slidably in the sliding direction, and have openings 48 above the slots to insert the pins thereinto.

Of the drawer 2 housing the image forming unit having the above configuration, the pin 42 at the back end portion of the bar 40 is pressed against the back of the body-side cam 43 when the drawer 2 is pushed in position into the body 1, and the spring 37 does not permit the cam to rotate. As a result, only the elastic force of the spring 39 effectively works on the slides 35 and 35' to place the cleaning unit 6 supported by the slides 35 and 35' in proper operation position close to the photosensitive unit 4. In other words, the cleaning unit 6 is kept in position (home position) by being pulled to the right direction of FIG. 3 by the spring 39.

On the other hand, when the drawer 2 is pulled out, the pin 42 on the back end of the bar 40 extending over the length of the drawer 2 is going to work out of the body-side cam 43. As a result, the rotational (torsion) force of the spring 37 is going to move the cam 41 to press the plate 34 on the sliders 35 and 35'. Because the spring 37 is designed to be stronger than the spring 39, the sliders 35 and 35' move toward the left side of FIG. 3, which results in the pins 44 and 44' on the cleaning unit 6 moving to the left direction, thus removing the cleaning unit 6 away from the photosensitive unit 4.

The above describes only the displacement of the cleaning unit 6, but the developing unit 5 also can be removed away from the photosensitive unit 4 in the same way, when the drawer 2 is pulled out.

In the above embodiment, in order to automatically remove each unit (set in the drawer 2) away from each other when the drawer 2 is pulled out of the body 1, a combination of a plurality of cam mechanisms makes the positional detection of the drawer 2, and also makes given units slide according to the detection. But, the invention is not limited to such a cam mechanism, but can use other means such as a combination of electrical detection of the drawer position and a electromagnetic mechanism driven thereby.

In the above embodiment, when taking out any one of the units to replace, pulling the drawer 2 out of the body 1 automatically removes the developing unit 5 and the toner cartridge 7 together away from the photosensitive unit 4 toward the right side of FIG. 2, and the cleaning unit 6 toward the left side. Therefore, the replacing operation is so simple and there is no chance of the adjoining units being damaged.

Next, the 2nd embodiment according to the invention will be described in detail referring to the drawings.

Figure 7:
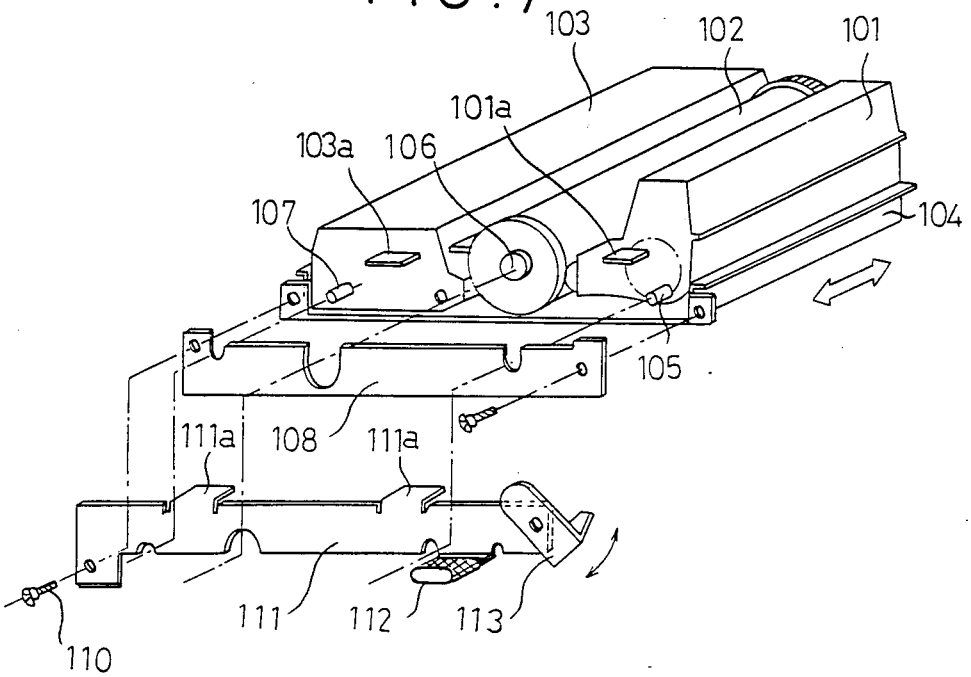
FIG. 7 is an exploded perspective view showing a second embodiment according to the invention.

FIG. 7 shows the 2nd embodiment of an image forming device according to the invention. A developing unit 101, a photosensitive drum 102 and a cleaning unit 103 are set in a case 104. They are set in the device body by loading these units and the case 104 integrally in the device body. Each of above units 101, 103 and 102 is located by inserting respectively positioning pins 105 and 107 as well as the boss (positioning pin) 106 of a bearing into U-shape openings of a positioning plate 108 attached to the front end of the case 104 with screws 109.

Figure 8:
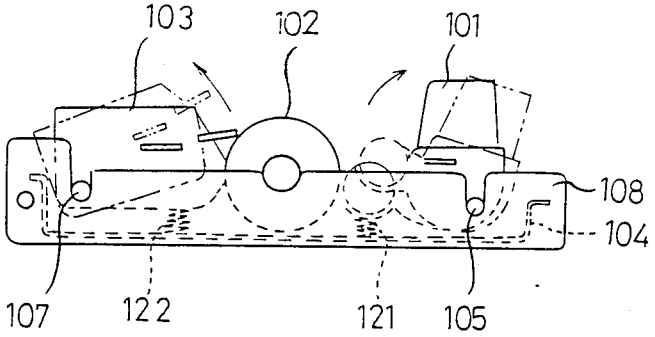
FIG. 8 is a front view of the second embodiment when a retaining plate is removed.

As shown in FIG. 8, compression springs 121 and 122 are installed on the bottom plate of the case 104 respectively under the developing unit 101 and the cleaning unit 103. The developing unit 101 and the cleaning unit 103 are respectively energized by the springs 121 and 122 so as to rotate respectively around the pins 105 and 107 as if the photosensitive unit lifts up. As shown in FIG. 7, a stepped screw 110 is screwed into a threaded hole at the left end of the front portion of the case 104, through a left-end hole in a holding plate 111 and a left-end hole in the positioning plate 108, so that the holding plate 111 can be rotated around this screw 110. To set these plates, hold a lever 112 attached to the right end of the holding plate 111, and press bent pieces 111*a* against stoppers 103*a* and 101*a* respectively on the cleaning unit 103 and the developing unit 101 while pressing down the positioning pins 105 and 107, to press down each unit and to set each unit in a given position. These units are fixed by engaging a stopper 113 attached to the right end of the holding plate 111 by use of pin, with the bottom edge of the positioning plate 108. Each unit is set in position by inserting the case 104 (together with each unit 101, 102 and 103 loaded therein) into the device body at this condition.

To replace each unit, the case is pulled out of the device body, and the stopper 113 is removed from the positioning plate 108. The force of the springs 121 and 122 will permit the developing unit 101 and the cleaning unit 103 to rotate respectively around the pins 105 and 107 as if the photosensitive unit 102 lifts up, thus both removing away from the photosensitive unit 102. Therefore, when replacing either of the developing unit 101, the photosensitive unit 102 and the cleaning unit 103, any unit can be removed without damaging any adjoining unit, thus preventing damage, finger prints attached, or toner spill due to contact. Because each unit cannot be taken out unless the holding plate 111 is removed, it is positively prevented that each unit is taken out without being separated from each other.

Using the above configuration and pulling out the replacement unit holding case, can remove the developing unit and the cleaning unit away from the photosensitive drum. But, in replacing the photosensitive unit, since the surface of the photosensitive member is not so hard, there is a possibility of a deterioration of its functions due to attaching finger prints on and damaging the surface of the photosensitive member by getting contact with the surface or scratching the surface with other members.

The above situation may necessitate a support mechanism of photosensitive member by which users can easily replace a photosensitive drum in an electrostatic recording apparatus without damaging the surface of the photosensitive member or getting contact with the surface.

This photosensitive drum holding mechanism is particularly useful when used together with the invention described above.

The photosensitive member holding mechanism consists of:

an outer cylinder having a trunnion fitting into a bracket attached to the front plate of the replacement unit holding case being pulled out of the device body, rotatable around a horizontal axis lateral to the pulling-out direction of the above case;

a socket fitting slidably into the above outer cylinder, being energized in a direction protruding toward the case insertion direction by a spring inserted between the bottom plate of the above case, and having an inner cylinder provided with a bottom plate and a means for prevention of working out from the above outer cylinder; and a journal portion fitting into the above socket slidable axially and rotatable around its axis, and constituting a cap of the above photosensitive member pressure fitted on one end of the shaft.

As a 3rd embodiment according to the invention, an image forming device incorporating the photosensitive drum holding mechanism of the above configuration is described in detail referring to the drawings.

Figure 9:
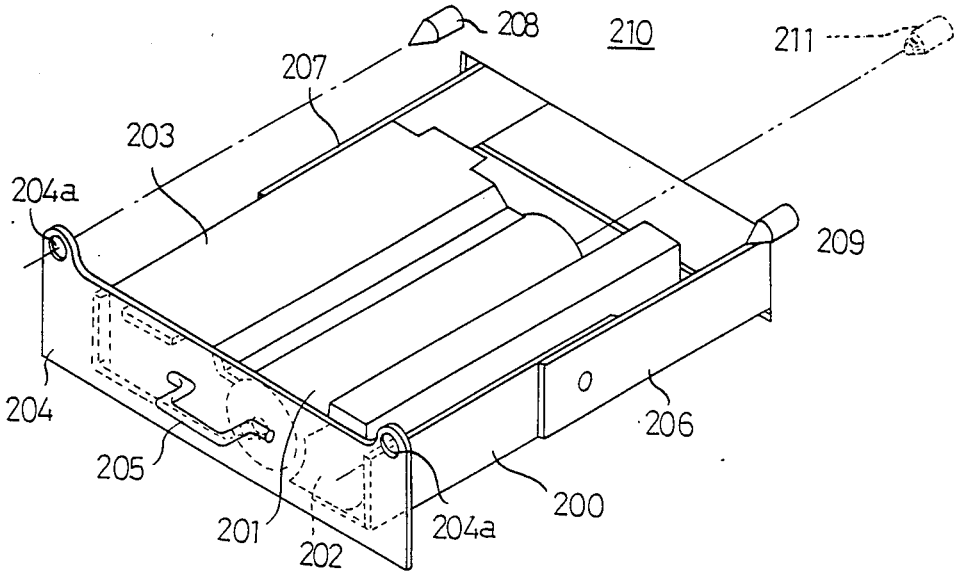
FIG. 9 is a view showing an image forming device of a third embodiment according to the invention, with a case removed.

FIG. 9 is a drawing showing an image forming device according to the 3rd embodiment. A photosensitive drum 201, a developing unit 202 and a cleaning unit 203 are housed in a case 200. In the figure, the case 200 has been pulled out of a device body of a printer or the like. The unit case 200 is guided by guide rails 206 and 207. On a front plate 204 of the case, a handle 205 is attached. Using this handle, the unit case 200 can be readily pulled out, to set other units. On the upper portions of the both ends of the front plate 204, positioning holes 204*a* are opened. Using these holes, the unit case 200 is placed in position by inserting (into these holes) pins 208 and 209 screwed into the front plate of the device body 210, when the unit case 200 is housed in the device body.

By pulling out the case, the developing unit and the cleaning unit are removed away from the photosensitive drum, and since the mechanism has been explained in the 1st and 2nd embodiments, this drawing omits its explanation.

Figure 10:
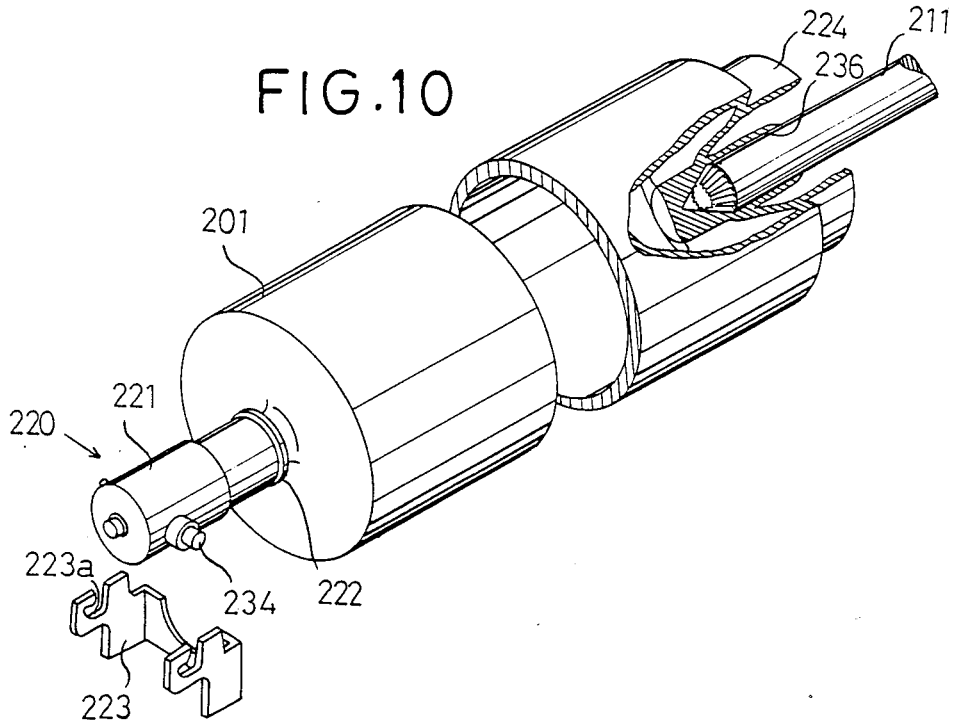
FIG. 10 is a perspective view showing end portions of the photosensitive drum.
Figure 11:
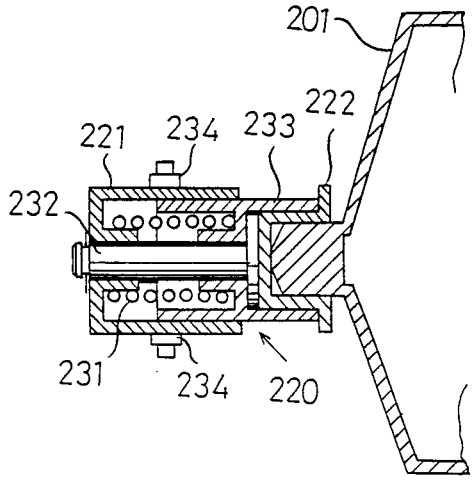
FIG. 11 is a sectional view showing the socket portion and the journal portion.
Figure 12:
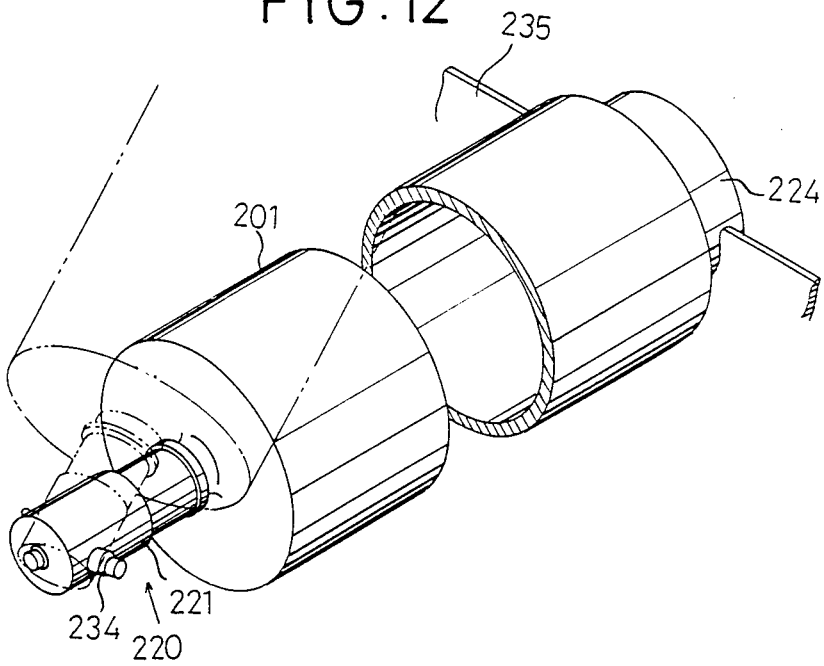
FIG. 12 is a perspective view showing the removing process of the photosensitive drum.

A mechanism for supporting a photosensitive drum in an image forming unit shown in FIG. 9 is explained referring to FIGS. 10 to 12.

The shaft front end of the photosensitive drum 201 is supported by inserting the end into a socket 220 disposed in the front plate 204 on the unit case 200, and a flange 224 at the back end is supported by an opening in a unit case back plate 235 as shown in FIG. 12. When the unit is inserted into the device body, the photosensitive drum 201 is supported by fitting a cylinder 236 having a conical portion (on its center) cut with a number of grooves inside along slant lines, onto a driving shaft 211 of the device body having a conical end with mating grooves.

The socket 220, as shown in FIGS. 10 and 11, consists of; an outer cylinder 221 provided with projecting trunnions 234, fitting into openings 223*a* in a bracket 223 attached to the front plate 204, and rotatable around the horizontal axis lateral to the pulling-out direction of the unit case 200; an inner cylinder 233 provided inside the above outer cylinder and rotatable in the axial direction; a compression spring 231 disposed inside between the bottom plate of the outer cylinder 221 and the bottom plate of the inner cylinder 233 provided inside thereof at the middle portion; and a shaft fixed into the bottom plate of the inner cylinder 233, with the front end thereof penetrating through the bottom plate of the outer cylinder having a retaining ring for prevention of its working out.

On the other hand, onto the front end shaft of the photosensitive drum 201, pressure fitted is the cap 222 slidable axially and rotatable around its axis in the inner cylinder 233 of the above socket 220, thus forming a journal for the inner cylinder 233.

As a result, when loaded, the conical hole inside the backside flange of the photosensitive drum 201 comes into a pressure contact with the end conical portion of the driving shaft 211 of the device body, to transmit the driving force by engaging both grooves with each other, as well as the photosensitive drum 201 is supported by the inner cylinder 233 in the socket 220 at the front end and by the driving shaft of the device body at the back end.

When replacing the photosensitive drum, the unit case is pulled out from the device body. The back end of the drum is removed away from the tip end of the driving shaft on the device body side, and the inner cylinder 233 in the socket 220 is pushed out by the spring 231 as shown in FIG. 11 until the retaining ring comes into contact with the outside face of the outer cylinder bottom plate. As the inner cylinder 233 is pushed out, the journal portion 222 of the photosensitive drum 201 extends out much longer than when it is loaded or operating. Then, as shown in FIG. 12, the journal portion 222 can be readily pulled out of the socket 220 to take out the photosensitive member, by raising the photosensitive drum 201 around the trunnion 234 of the socket 220 while pressing the flange 224 of the drum 201 toward you, and by lifting up the both end faces of the photosensitive drum 201 with hands.

Next, a new photosensitive drum can be loaded in the reverse order of the above, and supported by the socket 220 and the driving shaft 211 on the body side. It is desirable that a new photosensitive member be wrapped with protective paper to prevent the surface of the member from being spotted.

The above photosensitive member holding mechanism can improve the workability during the replacement of the drum in an electrostatic recording apparatus such as printers, thus allowing users to easily replace the photosensitive member without causing damage.

What is claimed is:

1. An image forming device for electrostatic recording apparatus which has a plurality of replacement units including a photosensitive drum, and a case housing replacement units and integrally removable from the device body by sliding said case toward one direction, and wherein each of said replacement units is placed in operable position when said replacement unit holding case is set to a given position in the device body, wherein:

said replacement unit holding case is provided with means for automatically changing the position of each of said replacement units further away from each other, than the given setting position of each of said replacement units by pulling out said replacement unit holding case; and said replacement unit holding case is provided with a photosensitive drum holding mechanism consisting of; a socket having an outer cylinder provided with trunnions fitting into a bracket attached to the inside face of a front plate of said replacement unit holding case, and rotatable around the horizontal axis lateral to the pulling-out direction of said case, and having an inner cylinder provided with a bottom plate for prevention of its working out slidably fitting into the inside of said outer cylinder, being energized in a direction projecting from the inner cylinder toward the inserting direction of the case by a spring disposed between the bottom plate of the outer cylinder; and a journal portion constituting a cap fitting into the inside of said inner cylinder in said socket slidable axially and rotatable around the axis, and pressure fitting on the one-side shaft end of said photosensitive member.

2. An image forming device for an electrostatic recording apparatus which has a plurality of replacement units including a photosensitive drum, and a replacement unit holding case integrally removable from the device body by sliding said case toward one direction, and wherein each of said replacement units in said replacement unit holding case is set to a given position in the device body, wherein:

said replacement unit holding case is provided with a photosensitive drum holding mechanism comprising a socket having trunnions fitting into a bracket attached to the inside face of the a front plate of said replacement unit holding case, and rotatable around the horizontal axis lateral to the pulling-out direction of said case, and a supporting means formed on a back plate of said replacement unit holding case for supporting a back end of the photosensitive drum.

3. An image forming device for electrostatic recording apparatus as claimed in claim 2, wherein:

said back end of said photosensitive drum is provided with an engaging portion adapted to engage a driving shaft to drive said photosensitive drum.

4. An image forming device for an electrostatic recording apparatus which as a plurality of replacement units including a photosensitive drum, and a replacement unit holding case integrally removable from the device body by sliding said case toward one direction, and wherein each of said replacement units is placed in operable position when said replacement unit holding case is set to a given position in the device body, wherein:

said replacement unit holding case is provided with a photosensitive drum holding mechanism comprising a socket having an outer cylinder provided with trunnions fitting into a bracket attached to the inside face of a front plate of said replacement unit holding case, and rotatable around the horizontal axis lateral to the pulling-out direction of said case, and having an inner cylinder provided with a bottom plate for prevention of its working out slidably fitting into the inside of said outer cylinder, said socket being energized in a direction projecting from the inner cylinder toward the inserting direction of the case by a spring disposed between the bottom plate of the outer cylinder, and said photosensitive drum mechanism further comprising a journal portion constituting a cap fitting into the inside of said inner cylinder in said socket slidable axially and rotatably around the axis, and pressure fitting on the one-side shaft end of said photosensitive member.

* * * * *